US006153274A

United States Patent [19]

Koo

[11] Patent Number: 6,153,274

[45] Date of Patent: Nov. 28, 2000

[54] SCENT-DISPENSING ARTIFICIAL FLOWER

[75] Inventor: Yue Sin George Koo, Hong Kong, China

[73] Assignee: United Chinese Plastics Products Company Limited, Kowloon, The Hong Kong Special Administrative Region of the People's Republic of China

[21] Appl. No.: 09/081,422

[22] Filed: May 19, 1998

[30] Foreign Application Priority Data

May 19, 1997 [GB] United Kingdom ..... 9710146

[51] Int. Cl.[7] ..... A41G 1/00

[52] U.S. Cl. ..... 428/24; 428/905; 239/53; 239/57

[58] Field of Search ..... 428/24, 905; 239/53, 239/57

[56] References Cited

U.S. PATENT DOCUMENTS

| | | | |
|---|---|---|---|
| 355,982 | 1/1887 | Eggert, Jr. . | |
| 3,400,890 | 9/1968 | Gould | 428/905 |
| 3,597,877 | 8/1971 | Speers | 428/24 |
| 3,861,991 | 1/1975 | Kim | 428/24 |
| 4,413,779 | 11/1983 | Santini | 239/45 |
| 4,708,851 | 11/1987 | Von Loringhoven | 428/905 |
| 4,708,900 | 11/1987 | Siegers | 428/905 |
| 4,919,981 | 4/1990 | Levey et al. | 428/905 |
| 4,928,881 | 5/1990 | Barlics et al. | 428/905 |
| 5,077,102 | 12/1991 | Chong | 428/24 |
| 5,544,812 | 8/1996 | Torres et al. | 428/905 |
| 5,776,561 | 7/1998 | Lindauer | 428/24 |

OTHER PUBLICATIONS

Copy of United Kingdom Search Report for GB 9710146.3.

*Primary Examiner*—Margaret Medley
*Attorney, Agent, or Firm*—Merchant & Gould P.C.

[57] ABSTRACT

A support for a scent-dispensing insert (20) for use in an artificial flower comprises a perforated enclosure including a body portion (16) and a releasable lid (18), the support being connectable to a scent-carrying tube (10) disposed in the stem of the flower.

20 Claims, 2 Drawing Sheets

SCENT-DISPENSING ARTIFICIAL FLOWER

The present invention relates to a scent-dispensing artificial flower, and to a support for a scent-dispensing insert for such a flower.

It has previously been proposed to provide artificial flowers which have a flower-like scent. In one such flower, the flower is provided with a hollow stem which contains a scented liquid, and at the end of the stem connected to the flower bloom includes a plug or tip of porous material from which the scent evaporates. A problem with such an arrangement arises in trying to maintain the plug in position on the scent-providing tube, this conventionally being push-fitted onto the end of the tube. The scent-dispensing plug may become dislodged or disconnected from the tube, such that scent is unable to reach the plug and the scent-dispensing ability is disrupted.

The present invention seeks to provide an arrangement to overcome this problem.

According to a first aspect of the present invention there is provided a support for a scent-dispensing insert for use in artificial flowers, comprise a perforated enclosure including a perforated body portion and a releasable lid.

The provision of such a support ensures that the dispensing plug may be firmly held in position on a fluid dispensing tube of the flower.

In a further aspect, the invention provides an artificial flower including a stem and a bloom connected to the stem, the stem including a hollow tube extending along the length thereof having at an end connected to the bloom an insert of porous material from which in use scent is dispensed held within a support in the form of a perforated enclosure in communication with the hollow tube, which support includes a perforated body portion and a releasable lid.

Preferably, the support includes a tubular portion depending from a lower region of the body portion, by which the enclosure can be fitted onto a scent-supplying 5.

The support may be in the form of a cylindrical cup including a base and side wall, and the lid comprises a circular element, securing means being provided on the cup and lid to secure the two together.

The lid may be formed as a separate part from the body, and the securing means comprise a number of protrusions on one of the lid or side walls which fit into corresponding apertures in the other of the lid and side wall.

Alternatively, the lid may be connected to the body portion by a hinge.

Embodiments of the invention are now described, by way of example only, with reference to the following drawings in which.

Figure 1:
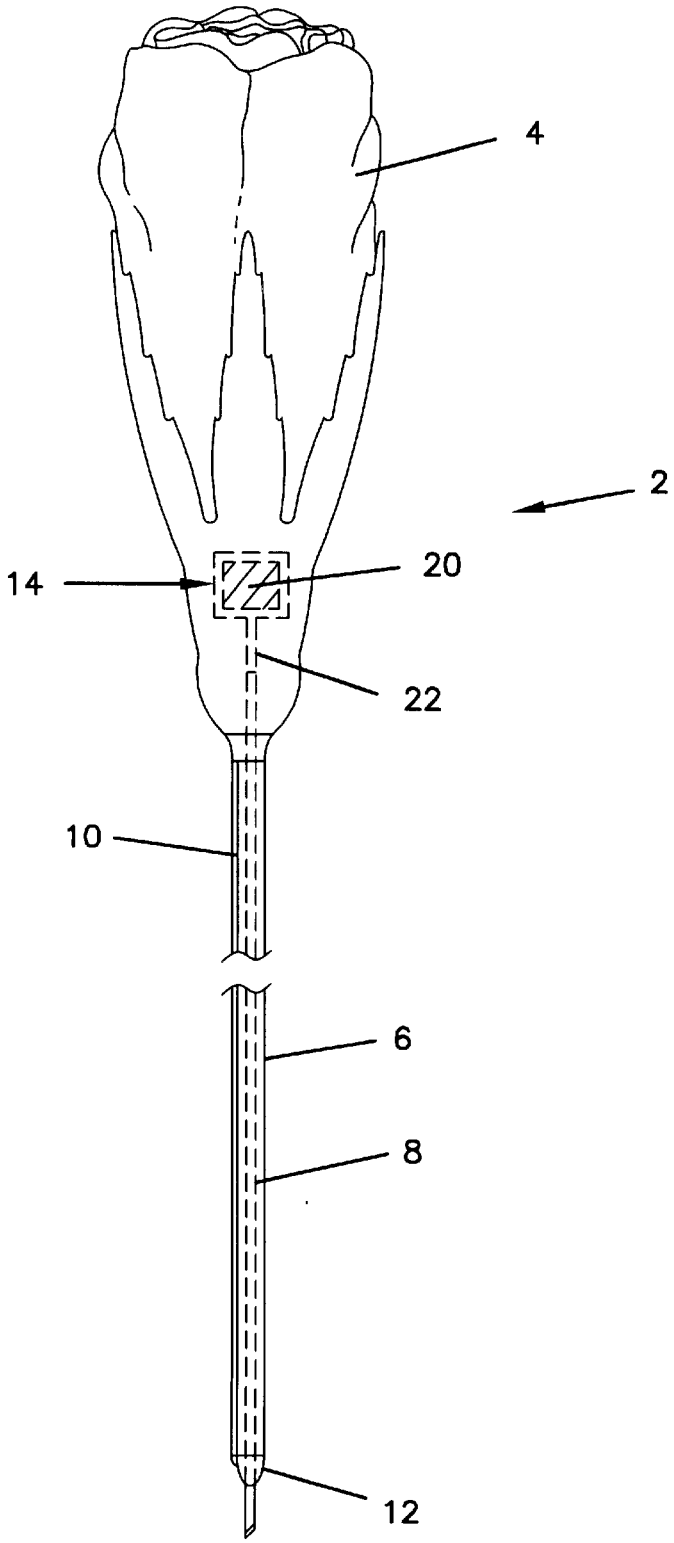
FIG. 1 shows an artificial flower in accordance with a first embodiment of the invention.

Turning to FIG. 1 of the drawings, this figure shows an artificial flower, generally designated 2, having a bloom 4 and stem 6. The stem 6 includes a hollow central tube 8 extending along the length thereof, which can be seen at a lower region of the stem 6 protruding therefrom. Also extending along the length of the stem is a reinforcing wire 10 which gives the stem increased rigidity and helps to support the bloom 4. The wire 10 is preferably formed of a length of metal wire. At the lower end of the stem 6 a plastics plug 12 secures the wire 10 to the tube 8. The tube 8 and wire 10 are enclosed within an outer sheath in the form of a layer of plastics material or paper, for example a waxed paper, which is preferably coloured green or brown in order to give the stem a realistic appearance.

At the upper region of the stem 6 the tube 8 extends into a lower region of the bloom 4. Fitted on the tube 8 is a scent-dispenser 14. As better seen in FIG. 2 this scent-dispenser 14 includes a support in the form of a basket-like enclosure including a cup-like body 16 and a lid 18, both of which include a lattice-like perforated structure to allow scent to escape therefrom. This may be formed of a variety of materials. A simple plastics moulding will suffice. In use, the support contains a cylindrical insert or tip comprising a plug of porous material 20 from which scent evaporates and is thereby dispensed into the air.

A lower region of the support includes a depending tubular portion 22, slightly larger than the tube 8, which makes a fluid-tight push-fit with the top of the tube 8. In order to allow the lid 18 to be secured to the body 16, the support is provided with upstanding protruding pins 24 which are received within corresponding apertures 26 on the lid part 18. As an alternative, the pins may be provided on the lid part, and received within corresponding apertures in the cup-like body. Other simple forms of connecting means, including clips or fasteners may be provided.

The plug 20 is formed of a porous material from which scent inserted into the tube 8 evaporates, thereby releasing scent from the flower. One such material is a polyester plastics material sold under the name Interflo having specification no. F/N35-250-5. In use, the scented liquid is introduced into the tube 8 by using the device which forces the fluid under pressure into the tube 8 until this saturates the plug 20. In use, the scented fluid is progressively drawn up the tube 8 as the fluid evaporates from the plug 20. Once the fluid has been exhausted, the flower may be recharged, by filling the tube 8 once again.

Figure 2:
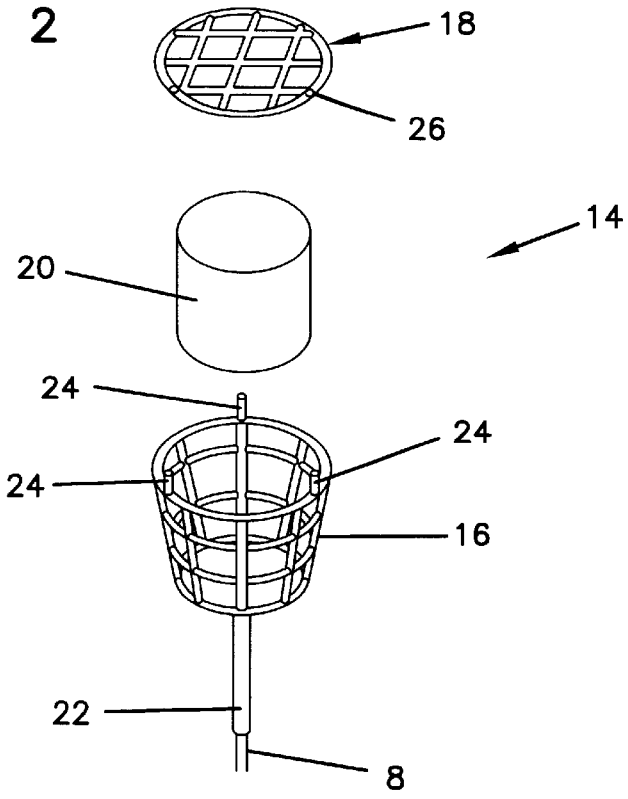
FIG. 2 is a disassembled view of a scent-dispenser including a support in accordance with the invention.
Figure 3:
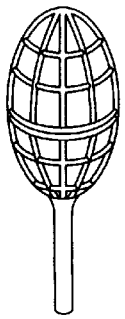
FIG. 3 shows an alternative form of support.
Figure 4:
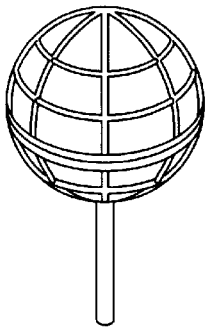
FIG. 4 shows a further alternative form of support.
Figure 5:
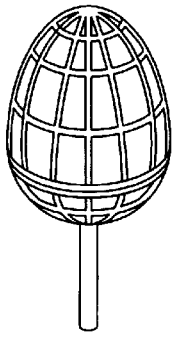
FIG. 5 shows a still further alternative form of support.
Figure 6:
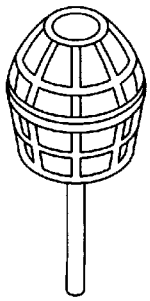
FIG. 6 shows a still further alternative form of support.

Other forms of support are shown in FIGS. 3 to 6, each including a lower body part and an upper lid part which may be separately formed, as in the embodiment of FIG. 2, or which may be connected through a hinged portion, in order to allow the plug 20 to be introduced and removed from the support.

The use of the dispenser 14 including the support ensures that the plug 20 is firmly held in position on the dispensing tube 8, ensuring that the supply of scented liquid to the plug 20 is maintained.

What is claimed is:

1. A support for a scent-dispensing insert for use in artificial flowers, in the form of an enclosure with perforations comprising a body portion and a releasable lid.

2. A support according to claim 1 including a tubular portion depending from a lower region of the body portion.

3. A support according to claim 1 wherein the support is in the form of a cylindrical cup including a base and side wall, and the lid comprises a circular element, securing means being provided on the cup and lid to secure the two together.

4. A support according to claim 3 wherein the lid is formed as a separate part from the body, and the securing means comprise a number of protrusions on one of the lid or side walls which fit into corresponding apertures in the other of the lid and side wall.

5. A support according to claim 1 wherein the lid is connected to the body portion by a hinge.

6. An artificial flower including a stem and a bloom connected to the stem, the stem including a hollow tube extending along the length thereof having at an end connected to the bloom an insert of porous material from which, in use, scent is dispensed held within a support in the form of an enclosure with perforations in communication with the hollow tube which includes a body portion and a releasable lid.

7. An artificial flower according to claim 6 wherein the support includes a tubular portion depending from a lower region of the body portion connected to said hollow tube.

8. An artificial flower according to claim 6 wherein the support is in the form of a cylindrical cup including a base and side wall, and the lid comprises a circular element, securing means being provided on the cup and lid to secure the two together.

9. An artificial flower according to claim 8 wherein the lid is formed as a separate part from the body, and the securing means comprise a number of protrusions on one of the lid or side wall which fit into corresponding apertures in the other of the lid and side wall.

10. An artificial flower according to claim 6 wherein the lid is connected to the body portion by a hinge.

11. A support according to claim 2 wherein the support is in the form of a cylindrical cup including a base and side wall, and the lid comprises a circular element, securing means being provided on the cup and lid to secure the two together.

12. A support according to claim 11 wherein the lid is formed as a separate part from the body, and the securing means comprise a number of protrusions on one of the lid or side walls which fit into corresponding apertures in the other of the lid and side wall.

13. A support according to claim 2 wherein the lid is connected to the body portion by a hinge.

14. A support according to claim 3 wherein the lid is connected to the body portion by a hinge.

15. A support according to claim 11 wherein the lid is connected to the body portion by a hinge.

16. An artificial flower according to claim 7 wherein the support is in the form of a cylindrical cup including a base and side wall, and the lid comprises a circular element, securing means being provided on the cup and lid to secure the two together.

17. An artificial flower according to claim 16 wherein the lid is formed as a separate part from the body, and the securing means comprise a number of protrusions on one of the lid or side wall which fit into corresponding apertures in the other of the lid and side wall.

18. An artificial flower according to claim 7 wherein the lid is connected to the body portion by a hinge.

19. An artificial flower according to claim 8 wherein the lid is connected to the body portion by a hinge.

20. An artificial flower according to claim 16 wherein the lid is connected to the body portion by a hinge.

* * * * *